US009849501B2

(12) United States Patent
Adams et al.

(10) Patent No.: US 9,849,501 B2
(45) Date of Patent: Dec. 26, 2017

(54) MULTIPLE BLOW MOLDED METALLIC CONTAINER SIDEWALLS

(71) Applicant: THE COCA-COLA COMPANY, Atlanta, GA (US)

(72) Inventors: John Adams, Alpharetta, GA (US); Rajesh Gopalaswamy, Alpharetta, GA (US); Simon Shi, Atlanta, GA (US); Wen Zeng, Atlanta, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 0 days.

(21) Appl. No.: 15/026,049

(22) PCT Filed: Sep. 30, 2014

(86) PCT No.: PCT/US2014/058403
§ 371 (c)(1),
(2) Date: Mar. 30, 2016

(87) PCT Pub. No.: WO2015/048775
PCT Pub. Date: Apr. 2, 2015

(65) Prior Publication Data

US 2016/0236261 A1 Aug. 18, 2016

Related U.S. Application Data

(60) Provisional application No. 61/884,643, filed on Sep. 30, 2013.

(51) Int. Cl.
*B21D 26/049* (2011.01)
*B21D 51/26* (2006.01)

(52) U.S. Cl.
CPC ..... *B21D 51/2607* (2013.01); *B21D 26/049* (2013.01)

(58) Field of Classification Search
CPC .. B21D 26/049; B21D 26/055; B21D 26/041; B21D 26/033; B21D 51/2646
USPC ..... 72/58
See application file for complete search history.

(56) References Cited

U.S. PATENT DOCUMENTS 3,224,239 A * 12/1965 Hansson ..... B21D 26/033 264/523
3,252,312 A * 5/1966 Maier ..... B21D 26/08 72/56
3,896,648 A * 7/1975 Schertenleib ..... B21D 26/041 29/421.1
5,214,948 A * 6/1993 Sanders ..... B21D 26/055 72/58

(Continued)

*Primary Examiner* — David B Jones
(74) *Attorney, Agent, or Firm* — Susanne Hollinger; Jim Patterson

(57) ABSTRACT

A system and method of forming a metal container with a featured sidewall may include providing a blow molded metal container. The metal container may be positioned into a mold inclusive of at least one sidewall feature. The metal container may be blow molded again to cause the at least one sidewall feature to be created in the sidewall of the container as defined by the mold. In one embodiment, a sidewall of the metal container may be at least partially annealed. The sidewall feature may include a portion of a profile of a sporting good, such as a baseball, embossed feature (e.g., word), logo, or otherwise. The metal container may be a shaped metal container.

18 Claims, 3 Drawing Sheets

(56) References Cited

U.S. PATENT DOCUMENTS

| | | | | |
|---|---|---|---|---|
| 5,970,767 | A * | 10/1999 | Hartman | B21D 51/2646 72/58 |
| 8,899,085 | B2 * | 12/2014 | Adams | B21D 26/049 72/370.22 |
| 9,321,093 | B2 * | 4/2016 | Adams | B21D 26/049 |
| 2011/0167886 | A1 * | 7/2011 | Mallory | B21D 26/049 72/58 |
| 2013/0192053 | A1 * | 8/2013 | Adams | B21D 26/049 29/527.4 |

* cited by examiner

MULTIPLE BLOW MOLDED METALLIC CONTAINER SIDEWALLS

BACKGROUND

Forming metallic containers, such as metallic containers used for consumer goods, and more particularly, metallic containers for consumer foods and beverages, has traditionally been performed by making conventional cans that are sealed with a lid. A variety of different lids have been used, including a sealed lid that requires a can opener to be opened and a sealed lid with a pull-tab that enables a user to peel open the lid. In both of these cases, the lid cannot be re-sealed.

More recently, metallic containers for beverages have been produced that are shaped in the form of a bottle. As an example, aluminum and steel bottles have been formed to resemble the shape of a beer bottle and sold at sporting events. These bottles are generally thick and are sealed with a crown cap, as understood in the art. Other metallic containers in the shape of bottles have been shaped to enable twist-off caps to be used.

Metallic containers that can be shaped in the form of a bottle offer several advantages over cans and glass bottles. First, metallic containers are more durable and do not shatter upon impact, such as dropping on a floor. Second, metallic containers are generally more lightweight than glass containers, thus costing less to ship and making it easier for vendors to carry. Third, metallic containers are less expensive than glass. Fourth, with respect to cans, metallic containers in the shape of bottles provide for easier gripping and offer the ability to marketers to provide more attractive containers to attract consumers.

While metallic containers in the shape of bottles ("metallic bottles") provide certain advantages over other container shapes, such as cans, and glass bottles, metallic bottles have heretofore been limited in the shapes that have been commercially feasible to produce. As an example, the number of steps that it currently takes to manufacture a shaped metallic bottle is generally over fifty. As a result, the amount of manufacturing equipment required is particularly high and production rates are particularly low. As another example, because metal, such as aluminum alloys or steel, when thinned has limited strength and has the tendency to bend or crinkle, forming thin metals to produce metallic bottles is challenging. Because of the tendency for thin metals to bend or crinkle, certain operations, such as die necking, are challenging and limits exist as to how much change in diameter can be made in a single step—historically not much more than 1%-2%. As understood in the art, it takes upwards of 350 lbs. or more of force to press a crown cap or twist-off cap onto a metallic bottle. As a result of the strength issues and capping force requirements, the thickness of the metallic bottles, especially at the neck and finish of the metallic bottle, has traditionally been high. While higher thickness of metals results in stronger bottles, the higher thickness limits the ability to shape intricate details in the metallic bottles and results in heavier metallic bottles. The heavier bottle adds to manufacturing and shipping costs, for example. As such, there is a need to use an alternative technique to manufacture metallic bottles to overcome thin metal limitations.

In addition to forming the metallic bottles, decorating metallic bottles by shaping or applying features to the sidewall of the metallic bottle is processing intensive as multiple steps are generally used to shape or apply features to the sidewall. A conventional process for shaping and applying features to the sidewall includes pressing metal to apply the desired shape or features to the sidewall while flat prior to the sidewall being formed into a metallic bottle shape.

SUMMARY

The principles of the present invention provide for performing multiple blow molding operations to metal to produce metal containers, such as metallic bottles. The metal may start as a metal preform composed of aluminum, such as aluminum alloys or steel. Because metal has a maximum strain beyond which the metal ruptures or fails (e.g., tears), a first pressure, such as pneumatic or hydraulic force, may be applied to the metal preform to cause the metal preform to reach a certain strain, and then at least a portion of the metal preform may be at least partially annealed, thereby causing a stress release in the metal. After the stress of the metal has been released, a second force, such as pneumatic or hydraulic force, may be applied to cause any portion of the metal preform that has not reached its final position within a mold to stretch to continue moving toward or reach a final position in the mold. As a result of using multiple blow molding operations, metallic bottles can be shaped in ways that have heretofore been impossible or commercially unfeasible to achieve.

One embodiment of a method of forming a metal container with a featured sidewall may include providing a blow molded metal container. The metal container may be positioned into a mold inclusive of at least one sidewall feature. The metal container may be blow molded again to cause the at least one sidewall feature to be created in the sidewall of the container as defined by the mold. In one embodiment, a sidewall of the metal container may be at least partially annealed. The sidewall feature may include a portion of a profile of a sporting good, such as a baseball, embossed feature (e.g., word), logo, or otherwise. The metal container may be a shaped metal container. The metal container may be a partially or fully formed metal container.

One embodiment of a system for forming a metal container with a featured sidewall may include providing a mold inclusive of at least one sidewall feature adapted to receive a blow molded metal container with the at least partially annealed sidewall. A blowing mechanism may be configured to blow mold the metal container again to cause the at least one sidewall feature to be created in the sidewall of the container as defined by the mold. The metal container may be a partially or fully formed metal container.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION

Figure 1:
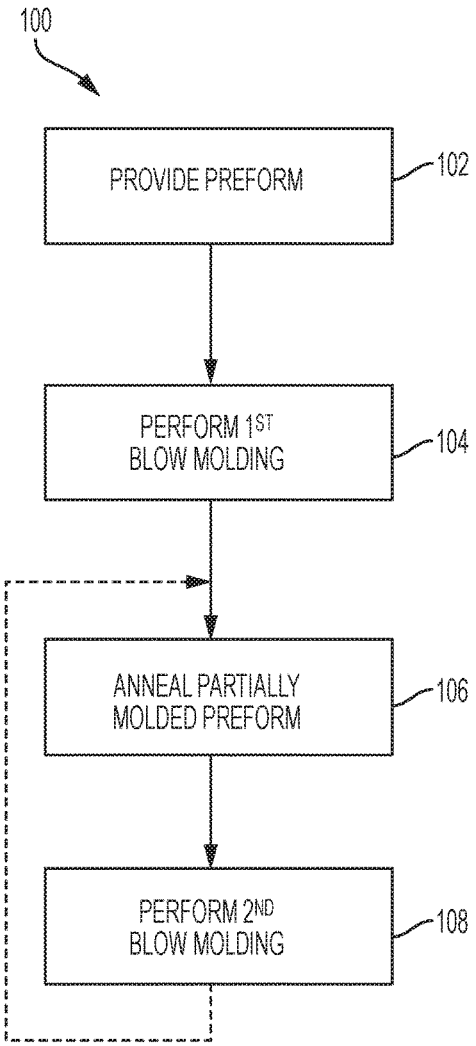
FIG. 1 is a flow diagram of an illustrative process for double blow molding a metallic vessel.

With regard to FIG. 1, a flow diagram of an illustrative process 100 for double blow molding a metallic vessel is shown. The metallic vessel may be in the shape of a bottle or any other container, as understood in the art. Because certain container shapes have dimensions that are difficult to manufacture using standard metal working techniques, the principles of the present invention may alleviate extensive manufacturing processes that allow for shaping metallic vessels with such dimensions, especially eliminating progressive die-necking type operations using a punch and die tool setup. As an example, many plastic bottles include feet that define a cavity within the plastic bottle. These feet, however, are difficult or not possible to form using conventional metal manufacturing processes because the dimensions are beyond deformation of thin metals during a blow molding or other metal shaping processes.

The process 100 starts at step 102, where a metallic preform ("preform") may be provided. The metallic preform may include a variety of different metallic compositions, including aluminum or steel. In one embodiment, an aluminum preform is composed of aluminum alloy. The aluminum alloy may be a 3000 series aluminum alloy (or even a 1000 series aluminum), and more specifically, but not by way of limitation, the aluminum alloy may be a 3104 series aluminum alloy. In providing the metallic preform, it is contemplated that the metallic preform may be provided by setting the metallic preform along a manufacturing line to be shaped into a metallic container, such as a bottle shaped container. Manufacturing of the metallic preform may be performed by a third party, such as a metallic preform manufacturer, such that a bottler may receive and provide the metallic preform to the manufacturing line. In an alternative embodiment, a bottler may receive a blank roll of metal, such as aluminum, and create a metallic preform from that blank sheet to provide the metallic preform to the manufacturing line.

The metallic preform may have any of a number of different shapes. For example, the preform may be tubular in the shape of a cup or cylinder (i.e., having sidewalls and bottom). The intersection between the sidewalls and bottom may be squared off (i.e., 90 degrees) or be curved. Alternative intersection designs may be utilized in accordance with the principles of the present invention. In one embodiment, the metallic preform may have a test tube shape or miniature bottle shape with an open end and a closed end. If the metallic preform is to be limited to a portion of an overall container (e.g., a container part) as opposed to ultimately defining an entire container, then the metallic preform may be limited in shape and size.

In addition to the preform having a certain shape, the preform may have a variety of different thickness dimensions. In one embodiment, the thickness dimensions are substantially equal along the entire preform. Alternatively, a bottom portion may be thicker if expansion along the axial plane may be used to form feet, for example. In one embodiment, if an upper portion of the preform is to be shaped to be a conventional closure, an upper portion of the preform may be thicker than the sidewalls. In one embodiment, the upper portion and bottom portions of the preform may be thicker than the sidewalls. In manufacturing the preform, the shaping may be formed with a substantially constant thickness and portions, such as the sidewalls, of the preform may be thinned or a shaped preform (i.e., certain portions of the preform may be thicker and thinner when manufactured). The thickness distribution along the length of the preform plays a role in the end shape and material distribution of the container, and may be manipulated or pre-configured to optimize the process (i) to minimize the weight of the preform and ultimately the container and/or (ii) to maximize the performance of the final shaped container.

At step 104, a first blow molding of the preform may be performed. The first blow molding may use 40 Bar or more to blow the metal. Lower pressures may be used to blow the metallic preforms as well. The blow molding may use pneumatic or hydraulic pressure blow molding. In one embodiment, the fluid of the blow molding may be at a temperature above room temperature, such as 200 degrees Celsius or higher. Because thin metals are limited in deformation due to strain limitations (i.e., an amount of strain or elongation that a metal can withstand before fracture), the strain resulting in deformation of the preform may cause the sidewalls to extend to contact mold walls within which the preform is positioned, while other portions of the preform, such as feet, that cannot be fully formed without fracture cannot reach the mold walls as a result of the first blow molding at step 104.

At step 106, the blow molded preform may be locally or entirely partially or fully annealed. That is, a portion (e.g., base or lower portion) of the blow molded preform or the entire blow molded preform may be annealed. As understood in the art, annealing causes stress in the metal to be "reset" or brought back to an initial stress-relieved state (also known as stress relaxation). That is, the grains of the metal that have been deformed (i.e., stretched or reshaped) and stressed are reset to an initial zero stress or stress relieved state. Partially annealing causes stress in the metal to be brought to a lower stress-relieved state, but not fully stress-relieved to an initial state. By at least partially annealing to reset the stress of the blow molded preform, another blow molding can be performed that lowers the risk of a subsequent blow molding from over-stressing the metal to cause the metal to fail. In one embodiment, rather than fully annealing the entire preform or localized portion of the preform, the annealing performed at step 106 may reduce the stress to a level that accommodates further desired deformation, but is not zero stress. For example, the preform may be partially annealed or normalized, both of which are considered equivalent in function. By providing for a partial annealing, time and energy may be reduced in the manufacturing process, thereby saving cost and improving production rate. In some cases, depending on the final container geometry desired, annealing prior to a subsequent (e.g., second) blow molding may not be necessary if the amount of strain that the metal will undergo in the subsequent blow molding process will be less than a strain that will cause the metal to fracture or otherwise deform.

At step 108, a second blow molding may be performed to the blow molded preform after the annealing process. The second blow molding 108 may cause portions of the blow molded preform to further deform to extend to the mold walls in which the blow molded preform resides. As an example, feet of a bottle that cannot be fully formed during the first blow molding at step 104 may be further deformed to reach the mold walls defining feet during the second blow molding 108. Because it may not be possible for two blows to cause the preform to fully deform to reach the mold walls, steps 106 and 108 may be repeated multiple times until the preform is fully molded. It should be understood, however, that the number of anneals and blows at steps 106 and 108 may be limited to the amount of stretch possible for the preform, which may be defined by the thickness of the metal, metal type, amount of annealing, and so on. In one embodiment, the fully shaped preform (e.g., bottle shape) may be left in whatever strain-hardened condition it is in after the second blow molding at step 108. Alternatively, the fully shaped preform, or portion thereof, may be fully or partially annealed to reset the metal to a less stressed state. Being in a strain-hardened state, however, may allow the container to be more durable for manufacturing, shipping, and consumer use. There may be commercial reasons for having the container be somewhat more pliable, so partial or full annealing may be performed after the container is fully shaped.

Figure 2:
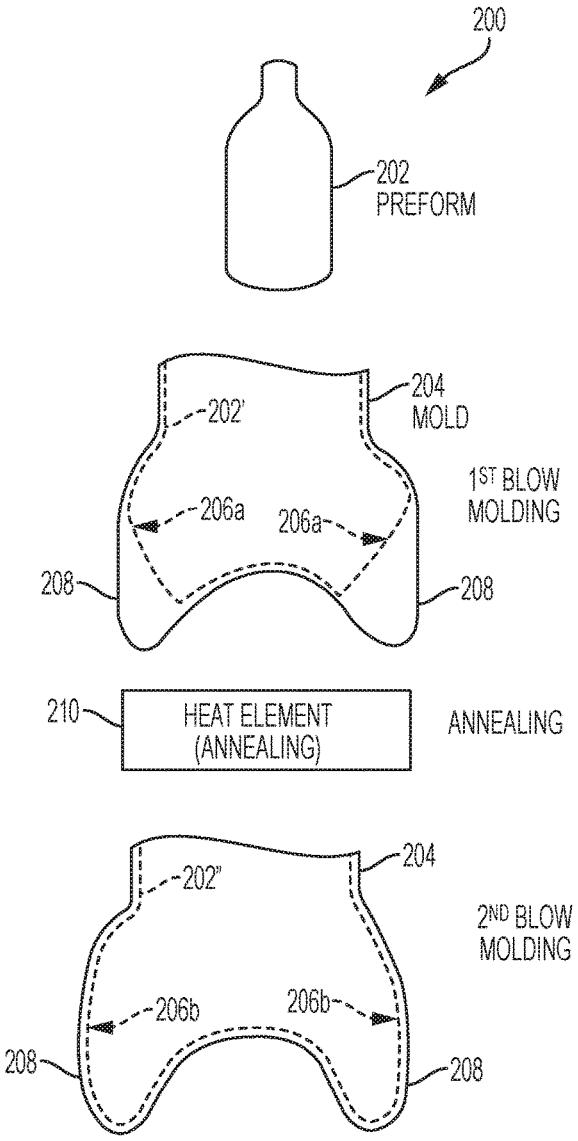
FIG. 2 is a process diagram of an illustrative process for double blow molding a metalling vessel corresponding with the process of FIG. 1.

FIG. 2 is a process diagram of an illustrative process 200 for double blow molding a metallic bottle corresponding with the process 100 of FIG. 1. The process 200 may start by providing a preform 202. A mold 204, which may be formed of single or multiple segments, may be provided. As understood in the art, the preform 202 may be disposed within the mold 204, to be blow molded. As previously described, in blowing the preform, pressure, such as 40 Bar or higher, may be applied within the preform to cause the preform to strain and deform. As a result of the deformation, the metal may be strain-hardened ("hardened"), as understood in the art. As shown, the preform 202 may result in a partially molded preform 202' that contacts certain portions of the mold (e.g., sidewalls), while other portions of the preform 206*a* do not contact other portions of the mold 208, which, in this case, are feet of a bottle mold.

A heat element 210, which may be an oven, heating element, open flame, or other heat source, may be used to perform whole or localized annealing, either fully or partially annealed, of the partially molded preform 202'. If a localized annealing process of the partially molded preform 202' is performed, then portions of the partially molded preform 202' remain in a strain-hardened state, while the annealed portions of the partially molded preform 202' are partially or entirely stress relieved and available for further blowing and deformation. As an example, the heat element 210 may be configured to perform a localized annealing on a portion of a sidewall in which a sidewall feature is to be created in a subsequent blow molding process. If a localized annealing is performed, then that localized annealed portion of the sidewall is to be indexed or otherwise aligned with a sidewall feature in a mold element. For example, if a logo is to be embossed into the preform 202 or partially molded preform 202', then the annealed portion of the sidewall is to be aligned with a mold element that contains the logo, thereby ensuring that the sidewall is molded without tearing. The portion of the sidewall that is at least partially annealed may have a larger area than the feature so that there is sufficient tolerance in aligning the at least partially annealed portion of the sidewall with the sidewall feature. As an alternative to performing a localized annealing of the sidewall, the entire sidewall (i.e., 360° around the preform) may be annealed. However, by at least partially annealing the entire sidewall, the portion(s) of the sidewall that is/are not thereafter deformed will be softer than portion of the sidewall in which a sidewall feature is included. Depending on the specific design, use, and hardness requirements of the final container, at least partially annealing the entire sidewall may or may not be commercially viable.

Continuing with FIG. 2, a second blow molding may be performed on the partially molded preform 202' to cause the partially molded preform 202' to continue being deformed. As shown, portions 206*b* of the partially molded preform 202' that were not fully deformed may be fully deformed so as to contact the other portions of the mold 208. As described with regard to FIG. 1, the process 200 may provide for multiple blow molding and annealing processes to fully deform the preform 202 into a fully molded preform 202". That is, the second blow molding may actually be a third or forth blow molding with intermittent annealing processes to at least partially reset the stress of the metal of the partially molded preform 202'.

Because the feet may be formed in a second or higher blow molding process, the portions 206*b* defining the feet may use a higher strain than other portions of the container, such as the sidewalls, which may extend to the mold 204 in a first or fewer blows. And, if the entire preform 202, which is being shaped into a container part, which may include being an entire container, is annealed between blows, the portions 206*b* will have a higher strain-hardness than other portions of the fully molded preform 202". If an annealing process is performed between blow moldings, such as annealing the portions 206*a* that are being shaped into feet, then the blow molding process may strain-harden the portions 206*b* to a higher level than other portions of the fully molded preform 202". And, because the axial depth of the portions 206*b* are greater than other portions of the fully molded preform 202", such as the radially shaped sidewalls or open end, deformation of the portions 206*b* are higher than deformations of the other portions of the fully molded preform 202".

Figure 3:
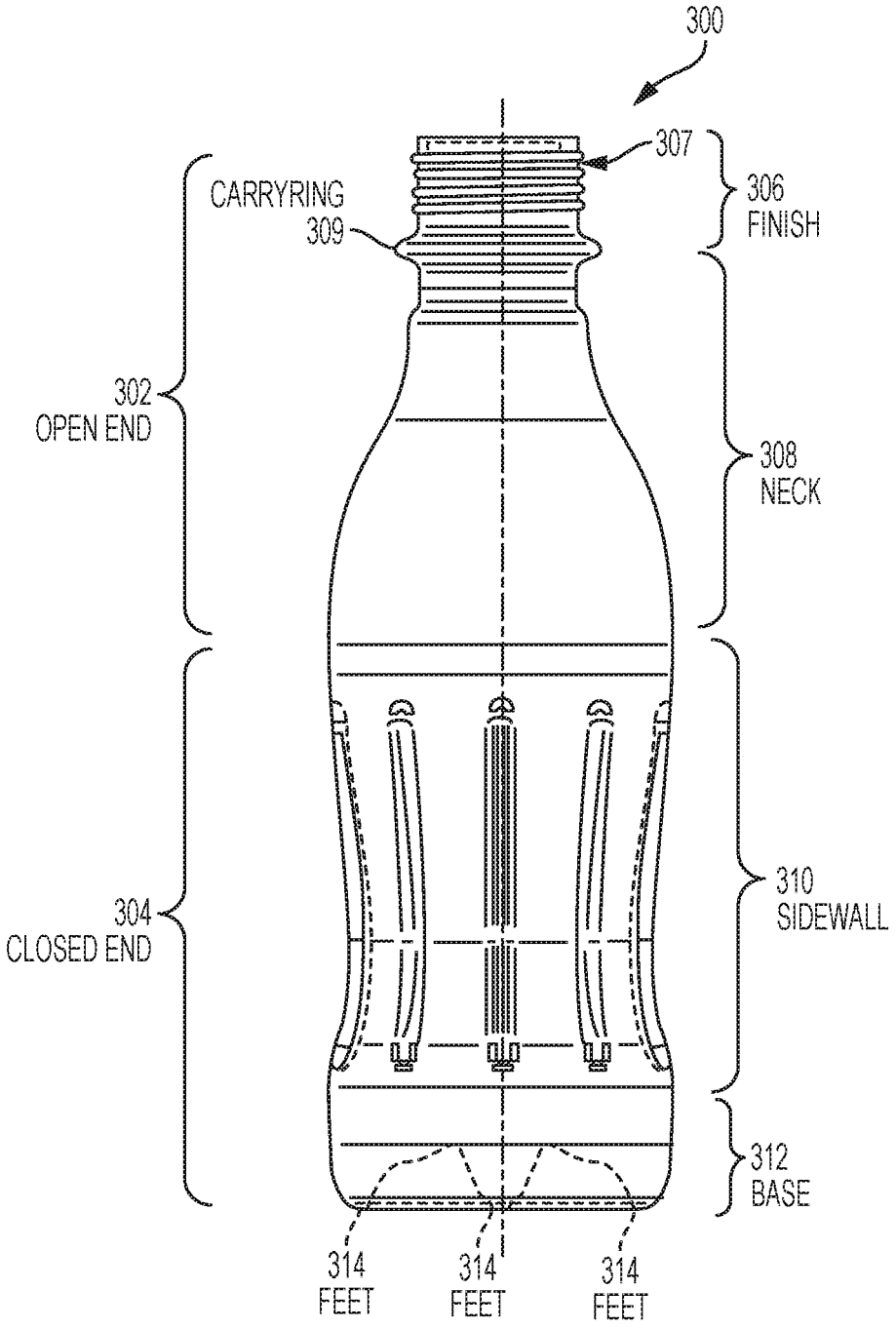
FIG. 3 is an illustration of an illustrative container shaped as a bottle inclusive of defined portions, as described herein.

With regard to FIG. 3, an illustration of an illustrative metallic container 300 shaped as a bottle inclusive of defined portions, as described herein, is shown. The container 300 includes an open end 302 and closed end 304. The open end 302 and closed end 304 are shown to be divided along a tapering portion of the container 300. It should be understood, however, that the open and closed ends 302 and 304 may have an alternative location along the container 300 at which each starts and stops. In accordance with the principles of the present invention, a preform may be configured to be formed into one, both, or a subsection of one of the open end 302 and closed end 304.

The open end 302 may include a finish region 306 that generally includes a threaded portion 307 and may or may not include carry ring 309, which is used during manufacturing of the container 300. A neck portion or neck 308 may be a tapering section extending from a sidewall portion or sidewall 310 to the finish portion 306. The sidewall portion may also be considered to include the neck portion 308. A base portion or base 312 may be a bottom portion of the container 300 on which the container rests. The base portion 312 may include multiple feet 314, such as, for example, at least two feet 314 that may, in part, define a cavity of the container 300 in which a beverage is stored. Further, the feet 314 may have any shape, such as, for example, individual external protrusions disposed about the circumference of the base 312 and/or rings concentrically disposed about one another and protruding from or defining, in part, the base 312.

As shown, a profile of the sidewall portion 310 is shown to be shaped. Because the sidewalls have limited variance (e.g., a waist), the blow molding process of FIG. 1 may accommodate for the shaping of the sidewall portion 310 in a single blow, which the feet 314, which are larger protrusions, may need two or more blow molds with intermittent annealing, either full or partial annealing, to enable the preform metal to extend to fully form the feet 314. A cap (not shown), which may be metal or plastic, may be used to seal the container with fluid therein, as understood in the art.

Referring back to FIG. 2, because the metallic preform 202 may be used to shape the portions 206*b* (i.e., feet 314) along with other portions of the fully molded preform 202", such as the base 312, sidewall 310, neck 308, and finish 306, a grain structure of the metal may extend between the open end 302 and closed end 304. In one embodiment, a container part may include feet 314 and base 312, and the base 312 may be attached to the sidewall 310, where the metallic grain structures may extend between the feet 314 and base 312 inclusive of a portion of sidewall above the feet 314. That is, the grain structures may extend and be continuous between multiple portions of the container 300 (e.g., neck and sidewalls, sidewalls and base and/or feet). The feet 314, thus, may have an integral and continuous grain structure with the base 312 and/or the sidewall 310 of the container 300. And, as a result, the feet 314 are integral with the closed end 304 and define a cavity within the container 300.

In addition to the principles of the present invention providing for producing blow molded metallic containers, such as bottles, that are thin and have features that are not part of the general shape of the containers. In one embodiment, the features may extend beyond features that are possible to create from a single blow due to the metal extending beyond a strain limit. Furthermore, the principles of the present invention provide for producing containers with high resolution sidewall features, such as embossing or other decoration style or feature. As with the previously described multiple blows separated by at least a partial annealing process there between to at least partially stress relieve metal, multiple blows separated by at least partially annealing the sidewalls, may be utilized. Such a multiple blow molding process may enable a feature, such as embossing, to be added to the sidewalls of the container. In one embodiment, the annealing may be localized in a limited region of the sidewall or the entire sidewall may be annealed (or partially annealed). The amount of annealing may vary from zero to a full stress-relieved metal depending on an amount of strain that exists in the previously blown sidewall, expansion of the sidewall to form the feature(s), detail in the feature(s), and so on.

For the purposes of this application, a "feature" created through a secondary blow molding process (i.e., either a second or later blow molding of at least a portion of a container) and applied to a sidewall of a container may be any geometrical, material or process related feature where the sidewall of the container is either deformed or formed from the previous stage of forming that the container has gone through, or in the case of a mold where it is subjected to forces and deforms permanently to conform partially or fully to the mold surface. Therefore, any geometrical, material attachment or process treatment that makes part of or the entire sidewall to undergo any permanent deformation compared to the previous shape and form of the container sidewall can be considered a feature on the sidewall.

Figure 4:
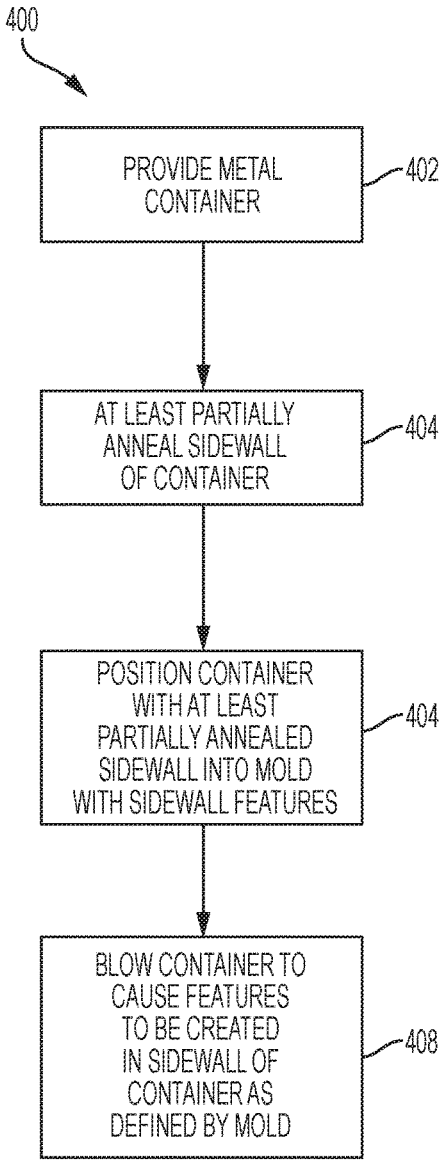
FIG. 4 is a flow diagram of an illustrative process for creating features in a sidewall of a container using a multiple blow molding process.

With regard to FIG. 4, a flow diagram of an illustrative process 400 for creating features in a sidewall of a container using a multiple blow molding process is shown. The process 400 may start at step 402, where a metal container may be provided. The metal container may be aluminum, steel, or any other thin metal that may be used for a beverage container, as previously described herein. Although the principles of the present invention provide for the metal container to have been previously blow molded to be a "blank" metal container (i.e., a container without any sidewall features), non-blow molded metal containers may also be utilized in accordance with the principles of the present invention. At step 404, a sidewall of the metal container may be at least partially annealed. In at least partially annealing the sidewall, the sidewall may be heated, either locally (i.e., a portion of the side wall) or entirely (i.e., the entire sidewall may be heated), to cause the sidewall to be respectively stress relieved partially or entirely (i.e., to a zero stress).

At step 406, the container with the at least partially annealed sidewall may be positioned into a mold with a sidewall feature. The mold may be a multi-segment mold (e.g., three segments, including two sidewall forming segments and one base forming segment). In one embodiment, the mold with the sidewall feature may the same or different mold than a mold used to originally form the "blank" container. If the same mold, then the features of the sidewalls may not have been fully formed in the initial blow process due to feature shape, resolution, or distance from center of the container. The container may be a portion or complete container. Positioning of the container within the mold may be performed automatically, as understood in the art.

The mold may be sized substantially the same as a mold, if different, from the mold that formed at least a portion of the container (e.g., portion of the container below a finish (i.e., top portion of a bottle that includes the threads), with the exception of a feature defining portion of the mold used to form a feature in the container. In one embodiment, the feature defining portion may protrude outward from the mold, where an inside wall of the mold protrudes from the surrounding portion of the inside wall of the mold that is shaped to otherwise substantially match the container. In another embodiment, the feature defining feature may extend inward from the surrounding portion of the inside wall of the mold that is shaped to otherwise substantially match the container. If an inward defining feature is utilized, a low, pre-pressure may be applied to the container prior to contacting the mold to the container, thereby minimizing chances of the container being deformed as a result of the contact prior to applying a higher pressure (step 408) to cause the inward feature to be formed in the container. In one embodiment, the pre-pressure may be 5 Bar or less, and the higher pressure may be 40 Bar or higher. Alternatively, low and high pressures may be utilized in accordance with the principles of the present invention.

At step 408, the container may be blow molded to cause features to be created in the side wall of the container as defined by the mold. In being blow molded, and as described above, higher pressure, such as 40 Bar, may be applied to the mold and container. As a result of blowing the container at the higher pressure, the sidewalls of the container may be expanded to be formed by the features of the mold. And, because the sidewalls of the container have been at least partially annealed, the sidewall portions that are altered to be formed into features may be hardened from their softened state as a result of being annealed. Hence, the features may end up having different hardness than surrounding portions of the sidewall that were not altered by the features defined by the mold. It should be understood that because the features of the sidewall may have different distances extending from or into the sidewall, that the hardness of the features, too, may vary depending how much stretching or deformation occurs from a feature being formed in the sidewall of the container. For example, in the case of a portion of a baseball feature with stitching features being formed from a sidewall of an aluminum bottle, a portion of the baseball feature that is farthest from the cylindrical shape of the sidewall (or center of the bottle itself) has the most stretch, and is therefore the most strain-hardened, while the portion of the baseball feature that is closest to the cylindrical shape of the sidewall is less strain-hardened as a result of having the least stretch from the feature forming process. Moreover, the stitching features that are part of the baseball feature may have a different hardness than the spherical portion of the baseball feature as a result of extending from the spherical portion and having details formed by small deformations.

Figure 5:
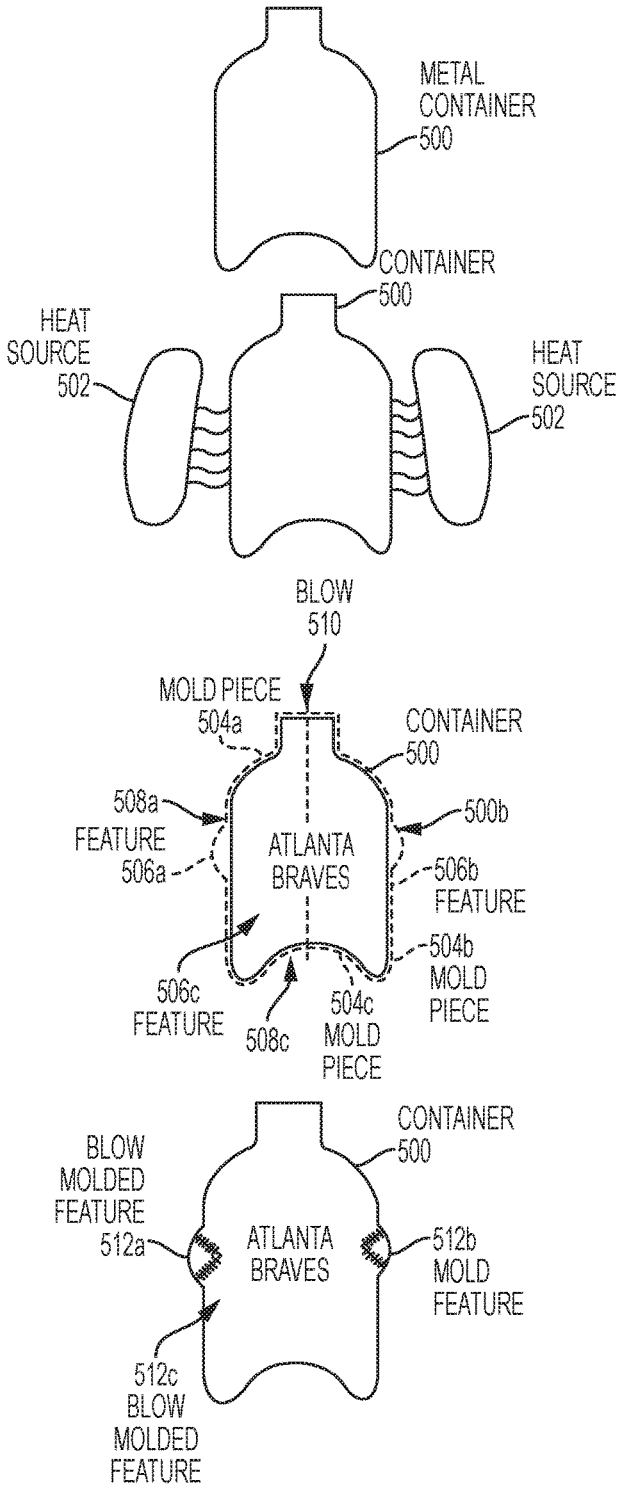
FIG. 5 is an illustration of an illustrative multiple blow molding process for creating features is a sidewall of a container.

With regard to FIG. 5, an illustration of an illustrative multiple blow molding process that corresponds to the process 400 of FIG. 4 for creating features in a sidewall of a metal container 500 is shown. The process may provide the metal container 500. The metal container 500 may be a whole container or a portion of a container (e.g., lower portion inclusive of a base). The container may be positioned near a heat source 502 that includes one or more heating elements. In positioning, the heat source 502 may be moved to be in proximate location to the container 500 or the container 500 may be moved to be in proximate location to the heat source 502. The heat source 502 may heat a local region or entire sidewall of the metal container 500 to at least partially anneal the sidewall. In an alternative embodiment, if the sidewall is not expanded to a failure point, then the sidewall can be blow molded further without fracturing the sidewall when forming a feature in the sidewall. It should be understood that the depth of the feature to be created on the sidewall may be used to determine whether or not the sidewall can be blow molded without causing failure of the sidewall by blowing a second time without at least partially annealing the sidewall (or may be used to determine how much annealing is to be performed).

A mold includes multiple mold pieces or segments 504*a*, 504*b*, and 504*c* (collectively 504) that include three mold features 506*a* (baseball half), 506*b* (baseball half), and 506*c* (embossed words) (collectively 506). It should be understood that the number of features may be one or more. The mold pieces 504 may form a complete mold when the mold pieces 504 are moved together using motions 508*a*, 508*b*, and 508*c* (collectively 508) using any electromechanical, hydraulic, pneumatic, or other process, as understood in the art. The complete mold may have substantially identical dimensions as the mold that created the container (i.e., length, width, and profile that does not allow the container to deform in any region other than the feature region(s). In one embodiment, the mold may be the same mold that created the container. However, by using a separate mold (i.e., one without features and one with features), "blank" containers may be formed that can thereafter have feature(s) applied thereto, and those feature(s) may be different for different purposes. The different purposes may include different events (e.g., baseball, football, auto racing, Olympic games, college events, etc.) or any other purpose (e.g., company logos, college logos, city memorabilia, cartoon characters, etc.). Moreover, small numbers of metallic containers with specific features may be produced from "blank" containers in an affordable manner and in a dynamic manner through use of a dynamic manufacturing system with one or more blow molding stations. In one embodiment, rather than using fixed molds, pixelized, dynamically configurable molds may be utilized that allow for three-dimensional (3D) features to be dynamically created to form the features.

After the mold is formed and positioned around the container 500, the container 500 may be blow molded 510 using a blowing mechanism, as understood in the art, via an opening in the container to cause a pressure, such as 40 Bar or higher, to force the sidewalls to expand into the features 506 of the mold. Resulting from the blow, molded features 512*a*, 512*b*, and 512*c* are created in the sidewall of the metal container 500. Depending on the resolution of the features to be created in the sidewall, the amount of pressure, amount of annealing, and/or other factors may be adjusted to accommodate the desired resolution, where the resolution includes intricacies or detail of the features. More specifically, as the metal is blow molded a first time, as the metal is stretched, it becomes strain-hardened, which may limit the ability for the metal to be shaped to have high resolution of a feature. As such, by at least partially annealing the metal, the metal can be better shaped to be formed with high resolution features. As an example, general shape of a football feature has low resolution, while stitching in the football is higher resolution. A team mascot, such as an eagle, may also have high resolution features (e.g., feathers, fur, eyes, etc.). Other features with different resolutions are possible. It should be understood that any feature shape that can be created in a mold and that the sidewall can withstand being formed into the feature without rupturing may be utilized in accordance with the principles of the present invention.

Blow molding a metal preform to create at least a portion of a metal container is one technique for producing a shaped metal container with sidewalls with features. Another technique for creating a shaped metal container with sidewall features may alternatively include starting with a straight wall cylinder formed using blow molding or fabrication techniques that do not use include blow molding. As such, cans or other shaped metal containers may utilize the multiple blow molding principles of the present invention to create metal containers with sidewalls inclusive of features.

The previous detailed description is of a small number of embodiments for implementing the invention and is not intended to be limiting in scope. One of skill in this art will immediately envisage the methods and variations used to implement this invention in other areas than those described in detail. The following claims set forth a number of the embodiments of the invention disclosed with greater particularity.

What is claimed:

1. A method of forming at least one molded feature in a container, said method comprising:

accessing a metal container with a sidewall;

at least partially annealing the sidewall of the metal container;

positioning the metal container into a mold inclusive of at least one mold feature; and blow molding the metal container to cause the at least one molded feature to be created in the sidewall of the metal container as defined by the at least one mold feature in the mold.

2. The method according to claim 1, wherein accessing the metal container includes providing a partially formed metal container.

3. The method according to claim 1, wherein accessing the metal container includes providing a fully formed metal container.

4. The method according to claim 1, wherein at least partially annealing the sidewall includes heating the sidewall to a temperature that causes metal grains of the sidewall to transition to a reduced stress state from an existing stress state.

5. The method according to claim 1, wherein at least partially annealing the sidewall includes at least partially annealing a localized portion of the sidewall.

6. The method according to claim 1, wherein positioning the metal container in the mold includes moving a plurality of mold pieces about the metal container, the mold pieces, when integrated or in contact with one another, having a profile that substantially matches a profile of the metal container with the exception of the at least one mold feature of the mold.

7. The method according to claim 1, wherein the at least one mold feature includes a portion of a profile of a sporting good.

8. The method according to claim 1, wherein the at least one mold feature includes an embossed feature.

9. The method according to claim 8, wherein accessing the metal container with the sidewall comprises accessing a metal container formed by blow molding.

10. The method according to claim 1, wherein the metal in the molded feature in the sidewall has a different hardness than metal in the sidewall surrounding the molded feature.

11. The method according to claim 1, wherein accessing the metal container includes providing a shaped metal container in a shape of a bottle.

12. A system for forming a metal container with a featured sidewall, said system comprising:

a heater configured to at least partially anneal the featured sidewall of the metal container;

a mold inclusive of at least one mold feature, and adapted to receive a blow molded metal container with a sidewall; and a blowing mechanism configured to blow mold the metal container again to cause the at least one mold feature to create at least one molded feature in the sidewall of the metal container.

13. The system according to claim 12, wherein the mold is configured to accept a partially formed metal container.

14. The system according to claim 12, wherein the mold is configured to accept a fully formed metal container.

15. The system according to claim 12, wherein the heater is configured to at least partially anneal the sidewall to a temperature that causes metal grains of the sidewall to transition to a reduced stress state from an existing stress state.

16. The system according to claim 12, wherein the heater is configured to heat the at least partially annealed sidewall in a localized portion of the sidewall.

17. The system according to claim 12, wherein the mold includes a plurality of mold pieces configured to be formed about the metal container, the mold pieces, when integrated or in contact with one another, having a profile that substantially matches a profile of the metal container with the exception of the at least one mold feature of the mold.

18. The system according to claim 12, wherein the at least one mold feature includes a portion of a profile of a sporting good.

* * * * *